US009425525B2

(12) United States Patent
Walden et al.

(10) Patent No.: US 9,425,525 B2
(45) Date of Patent: Aug. 23, 2016

(54) INTERPOSER ASSEMBLY AND METHOD

(71) Applicant: Amphenol InterCon Systems, Inc., Harrisburg, PA (US)

(72) Inventors: John D. Walden, Mechanicsburg, PA (US); James S. Hileman, Carlisle, PA (US); Charles Sands Pickles, York, PA (US)

(73) Assignee: Amphenol InterCon Systems, Inc., Harrisburg, PA (US)

( * ) Notice: Subject to any disclaimer, the term of this patent is extended or adjusted under 35 U.S.C. 154(b) by 0 days.

(21) Appl. No.: 14/857,942

(22) Filed: Sep. 18, 2015

(65) Prior Publication Data

US 2016/0087360 A1 Mar. 24, 2016

Related U.S. Application Data

(60) Provisional application No. 62/053,266, filed on Sep. 22, 2014.

(51) Int. Cl.
*H01R 12/70* (2011.01)
*H01R 12/71* (2011.01)
*H01R 13/24* (2006.01)

(52) U.S. Cl.
CPC ..... *H01R 12/7082* (2013.01); *H01R 12/714* (2013.01); *H01R 13/2435* (2013.01)

(58) Field of Classification Search
CPC ..... H01R 12/714; H01R 12/7082; H01R 13/2435
See application file for complete search history.

(56) References Cited

U.S. PATENT DOCUMENTS

| | | | | |
|---|---|---|---|---|
| 4,927,639 | A * | 5/1990 | Ghebre-Sellassie | A61K 31/19 424/468 |
| 6,173,707 | B1 | 1/2001 | Howell et al. | |
| 6,176,707 | B1 | 1/2001 | Neidich et al. | |
| 6,217,342 | B1 | 4/2001 | Neidich et al. | |
| 6,290,507 | B1 | 9/2001 | Neidich et al. | |
| 6,315,576 | B1 | 11/2001 | Neidich | |
| 6,730,134 | B2 | 5/2004 | Neidich | |
| 6,832,917 | B1 * | 12/2004 | Neidich | H01R 13/2435 439/66 |
| 6,905,343 | B1 * | 6/2005 | Neidich | H01R 13/2435 439/66 |
| 7,052,284 | B2 | 5/2006 | Liao et al. | |
| 7,621,755 | B2 * | 11/2009 | Kubo | H01R 13/2435 439/66 |
| 7,625,216 | B2 | 12/2009 | Mendenhall et al. | |
| 8,672,688 | B2 | 3/2014 | Florence, Jr. et al. | |
| 2003/0003784 | A1 * | 1/2003 | Neidich | H01R 13/2435 439/82 |
| 2005/0174746 | A1 * | 8/2005 | Hsiao | H01R 13/2435 361/769 |
| 2008/0050939 | A1 | 2/2008 | Polnyi | |
| 2014/0045350 | A1 | 2/2014 | Taylor | |

OTHER PUBLICATIONS

International Search Report dated Dec. 17, 2015 in corresponding PCT Application No. PCT/US15/50935, ISA—US Patent and Trademark Office, 10 pages.
Drawings of prior art interposer assembly—Figures 10 and 11.

* cited by examiner

*Primary Examiner* — James Harvey
*Assistant Examiner* — Oscar C Jimenez
(74) *Attorney, Agent, or Firm* — Hooker & Habib, P.C.

(57) ABSTRACT

The application discloses an improved interposer assembly with a molded plastic plate and stamp-formed metal contacts inserted in through passages in the plate. The contacts have redundant separate metal circuit paths extending between opposed contact points to reduce inductance and contact resistance.

15 Claims, 8 Drawing Sheets

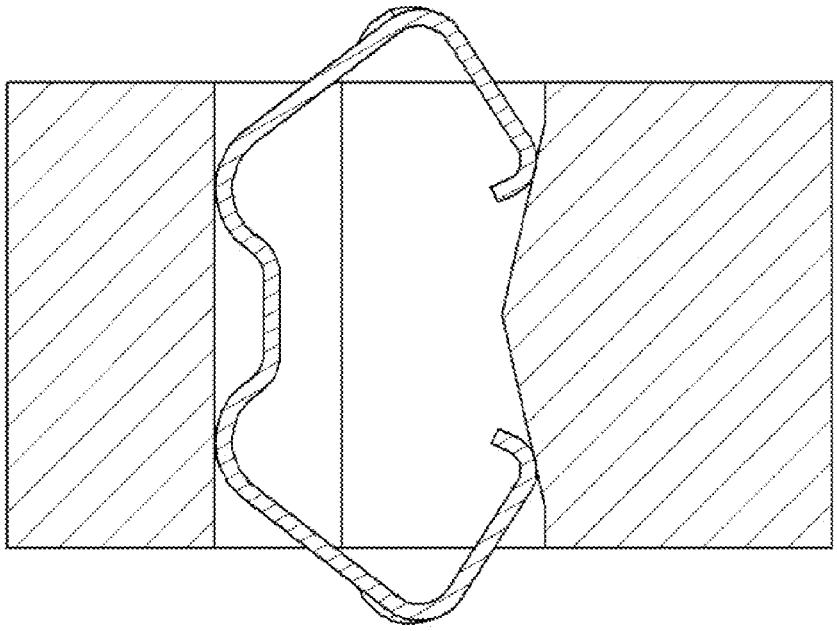
Fig. 10 - PRIOR ART
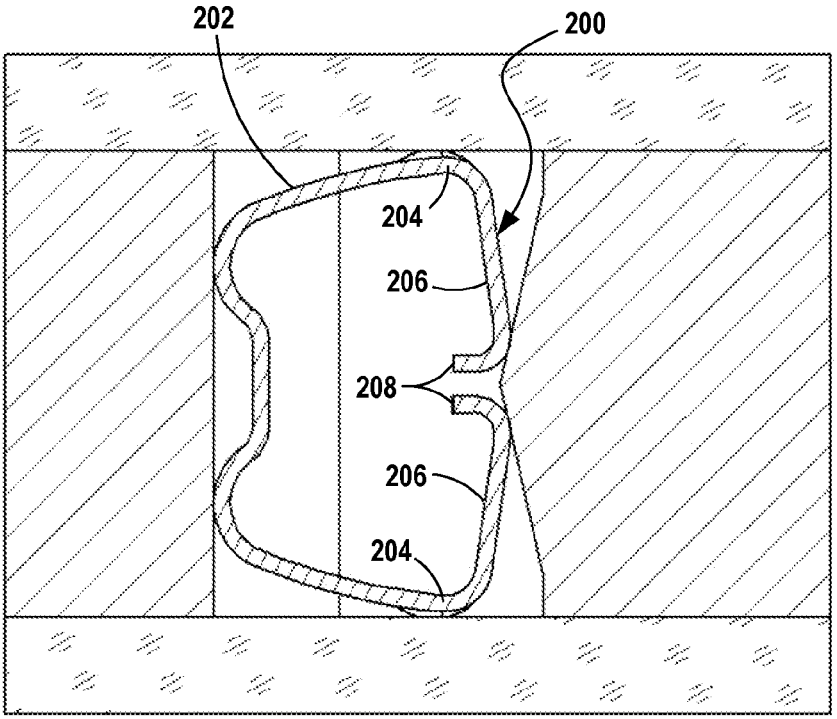
Fig. 11 - PRIOR ART

INTERPOSER ASSEMBLY AND METHOD

BACKGROUND OF THE DISCLOSURE

Interposer assemblies with molded plastic plates and inserted metal contacts in the plates are used for forming electrical connections between contact pads on opposed substrates. The contacts are spaced very close together in land grid array rows and columns to establish a large number of differential pair signal and ground connections extending through the plate.

Increased circuit speed requires transmission of differential signals through interposer plates at signal frequencies of 10 or more gigahertz. Transmission of high-frequency signals through conventional interposer plates with short, closely spaced single circuit path contacts and very fast rise times for the signals increases signal impedance and degrades signal strength. High-frequency signaling can cause cross-talk between adjacent pairs of signal circuit path contacts. FIGS. 10 and 11 illustrate a conventional interposer assembly with contacts forming single circuit paths between pads on opposed substrates.

The prior art interposer assembly shown in FIGS. 10 and 11 uses contacts 200 with single circuit paths 202 extending between contact points 204. The portions or stubs 206 of the contacts 200 extending from points 204 to free ends 208 do not carry current. These stubs extend outside of the electrical current path or loop for the contact and act as antennas. The antennas radiate energy and increase signal loss, particularly at high signal frequencies.

SUMMARY OF THE DISCLOSURE

An interposer assembly is disclosed with improved contacts for forming redundant electrical connections between contact pads on opposed substrates. Each contact in the assembly has two separate circuit paths between contact points which engage opposed substrate pads. The two circuit paths in each contact reduce inductance and contact resistance. The redundant circuit path eliminates the electrical contact stub that significantly contributes to signal degradation at high speeds.

The improved contacts with redundant circuit paths are inserted into a conventional dielectric plate without the need to tool and manufacture a specialized plate. Manufacturing cost of the improved assembly is reduced by use of the conventional plate.

DESCRIPTION OF THE DRAWINGS

FIGS. 10 and 11 are sectional views of a prior art interposer assembly.

DESCRIPTION OF THE PREFERRED EMBODIMENTS

Figure 1:
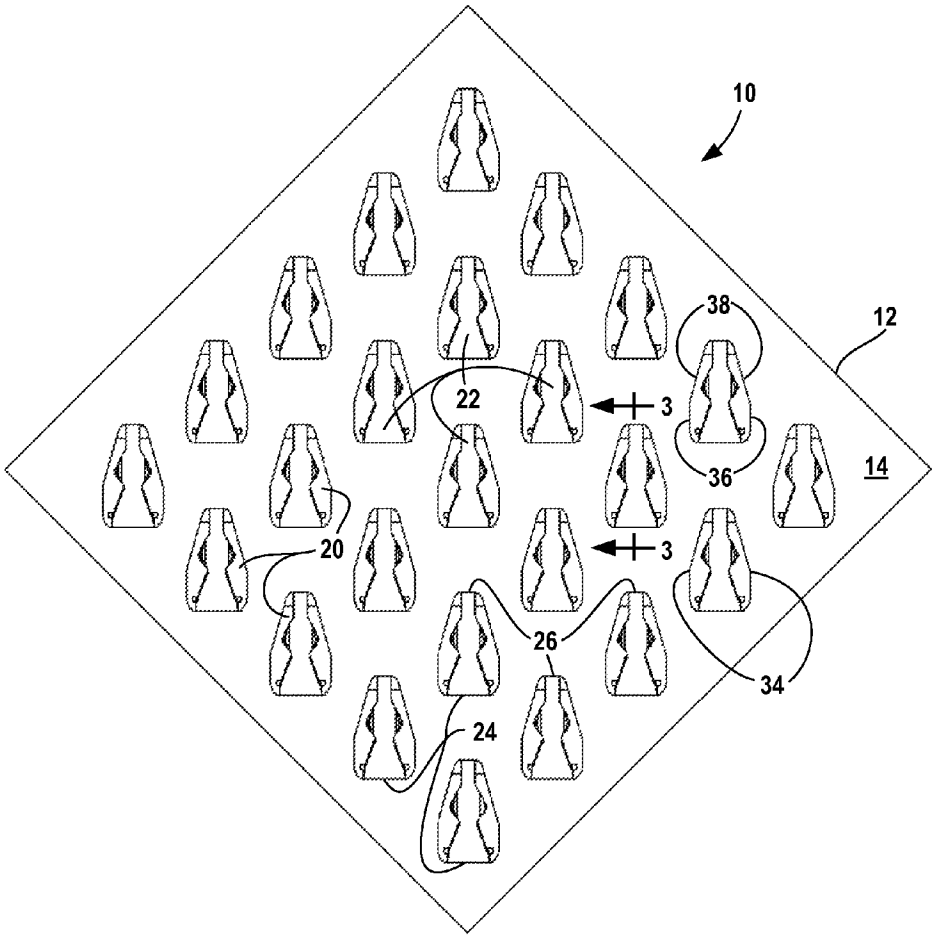
FIG. 1 is a top view of interposer assembly.

Interposer assembly 10 has a flat dielectric plate 12 with parallel top and bottom surfaces 14 and 16, a uniform thickness 18 and closely spaced contact passages 20 arranged in intersecting land grid array rows and columns. The plate may have a thickness of 1.22 mm. Formed metal contacts 22 are positioned in contact passages 20.

In plate 12, each contact passage 20 has a wide end wall 24 and an opposed narrow end wall 26. End wall 24 is flat and extends perpendicularly between the parallel top and bottom surfaces 14 and 16. Narrow end wall 26 includes a contact retention protrusion 28 which extends into passage 20. The protrusion 28 has two flat and inwardly angled cam surfaces 30 and 31 and a tip 32 at the intersection of surfaces 30 and 31 located equidistant between top and bottom surfaces 14 and 16.

Figure 2:
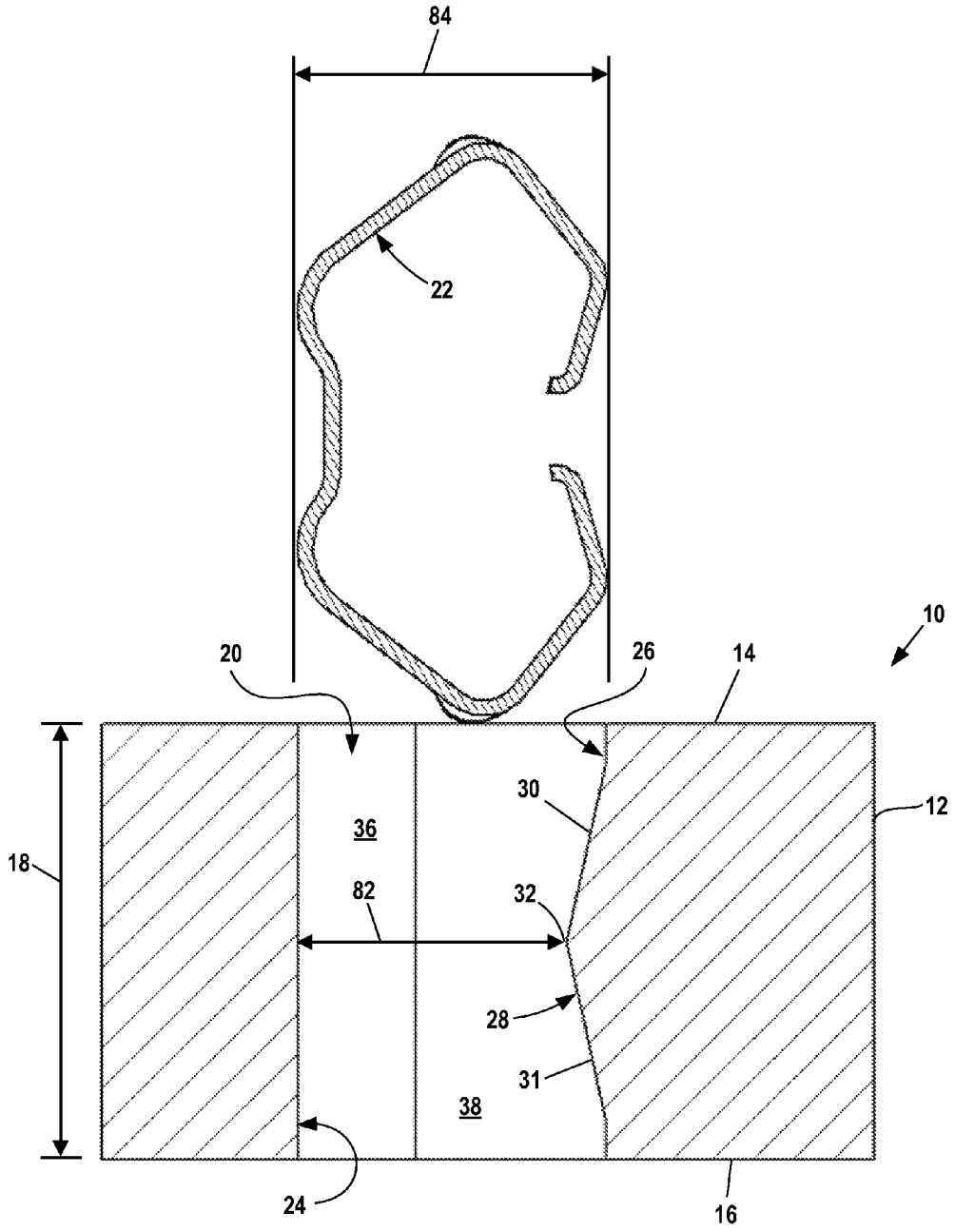
FIG. 2 is a sectional view illustrating a contact in position to be inserted in a through passage in an interposer plate.

The flat cam surfaces 30 and 31 on wall 26 extend from tip toward the top and bottom surfaces 14 and 16 at a shallow outward angle. As shown in FIG. 2, wall 24 is perpendicular to surfaces 14 and 16, and the width of passage 20 increases to either side of tip 32.

Passages 20 have opposed sidewalls 34 extending between end walls 24 and 26. Each sidewall 34 includes a flat portion 36 extending perpendicularly between the top and bottom surfaces 14 and 16 and perpendicularly from one edge of wide end wall 24. Flat, inwardly tapered sidewall portions 38 extend from the edge of narrow end wall 26 away from end wall 26 to portion 36. Portions 36 and 38 are perpendicular to top and bottom surfaces 14 and 16. As illustrated in FIG. 1, each passage 20 has a maximum width between wall portions 36. The width of the passage is reduced along portions 38 to a minimum width at narrow end wall 26.

Plate 12 is identical to the plate used in the prior art interposer assembly shown in FIGS. 10 and 11.

Metal contacts 22 are stamp formed from uniform thickness gold coated beryllium copper strip stock. The stock may have a thickness of 0.043 mm. Each contact has a rigid vertical spine 40 with rounded upper contact support 42 and rounded lower contact support 44 at the ends of the spine.

A first flat spring arm 46 angles upwardly and inwardly from support 42 to contact point 48 at the top of contact 22. A second flat spring arm 50 angles downwardly and outwardly from point 48 to support bend 52 which faces away from spine 40. End strip 54 extends downwardly and inwardly from bend 52 to rounded end 56. The contact is vertically symmetrical to either side of the center of spine 40 so that the lower half of the contact has flat spring arm 58, lower contact point 60, flat spring arm 62, support bend 64, end strip 66 and rounded end 68. A pair of contact tips 70 are provided on the opposed edges of contact points 48 and 60. Tips 70 are disclosed in U.S. Pat. No. 6,905,343.

Flat spring arm 58 extends downwardly and inwardly from lower contact support 44 to lower contact point 60, opposite from point 48. Flat spring arm 62 extends upwardly and outwardly from contact point 60 to rounded support bend 64. Contact end strip 66 extends up and in from bend 64 to rounded end 68. The widths of arms 46 and 58 decrease away from spine 40 to distribute stresses when the arms are stressed.

Contact 22 is formed from a long and relatively narrow length of uniform thickness metal strip stock bent in the form of an elongate circumferential band 72 with a gap 74 in the band 72 between contact rounded ends 56 and 68. The band 72 has a continuous circumferential inner surface 76 and a continuous circumferential outer surface 78. Surfaces 76 and 78 are perpendicular to a transverse plane 80 extending through the center of the band, illustrated in FIG. 4. As shown in FIG. 2, the minimum width 82 of passage 20 at tip 32 is less than the maximum width 84 of contact 22.

Figure 3:
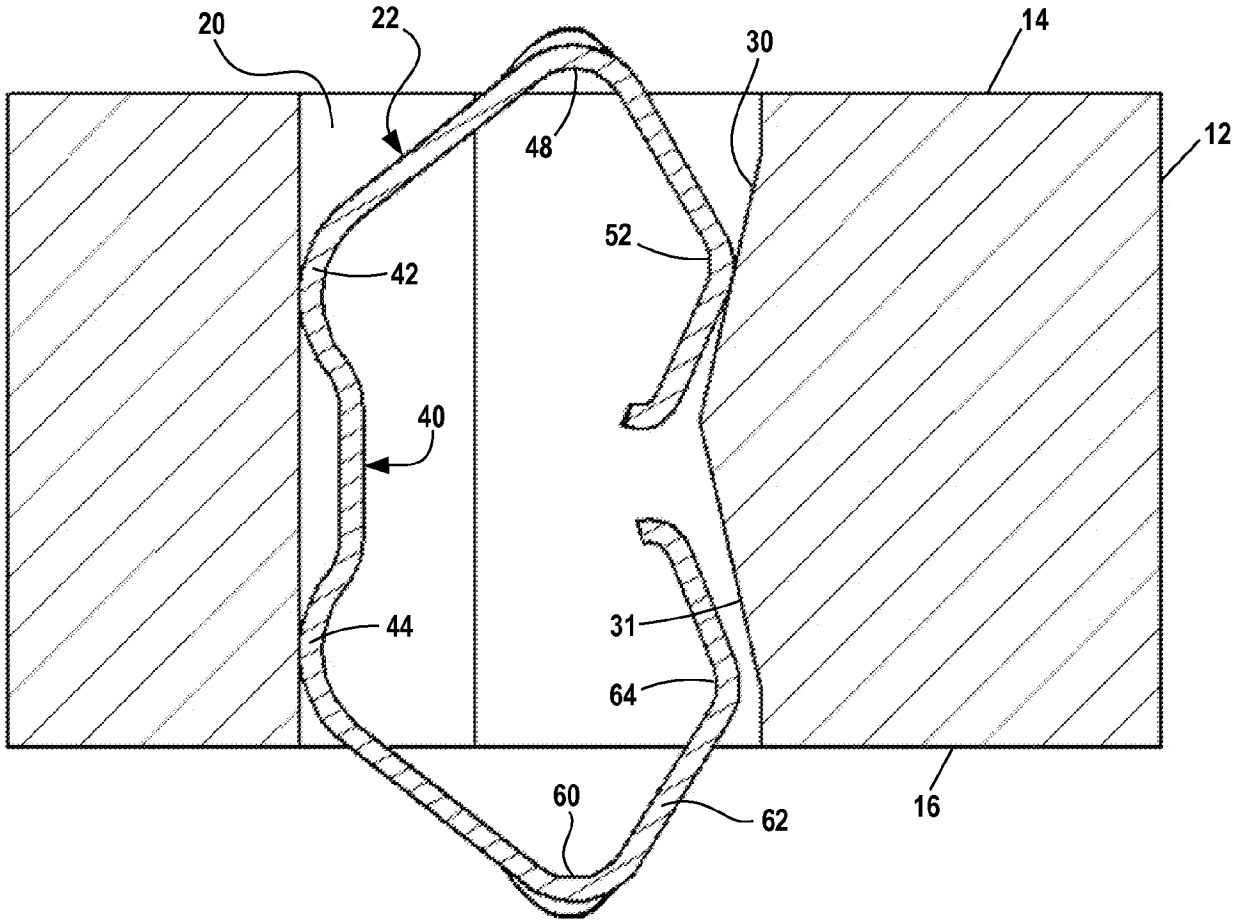
FIG. 3 is a sectional view taken along line 3-3 of FIG. 1 showing the contact in the plate in a gravity down position.

Contacts 22 are inserted into passages 20 by positioning the contacts above the passages, as shown in FIG. 2, and then lowering the contacts down into the passages to the positions shown in FIG. 3. The contacts are positioned with spines 40 above wide end walls 24 and arms 50, 54, 62 and 66 above narrow end walls 26. During insertion of the contacts, the spine supports 42 and 44 move down along walls 24, and arms 62 are moved down to engage the upper cam side 30 of narrow end wall 26. The arms 58 and 62 are flexed by cam side 30 and are moved over tip 32 and return to the uncompressed position with the contact inserted in the passage, as shown in FIG. 3. The contact has a loose fit in the passage 20 with limited free vertical movement in the passage. Supports 42 and 44 rest on the walls 24. As shown in FIG. 3, the contact 22 is in a gravity down position with support bend 52 on upper cam side 30 and support bend 64 spaced inwardly from lower cam side 31. Upper contact 48 is adjacent plate top surface 14. Lower contact 60 is spaced a greater distance below lower plate surface 16.

Figure 4:
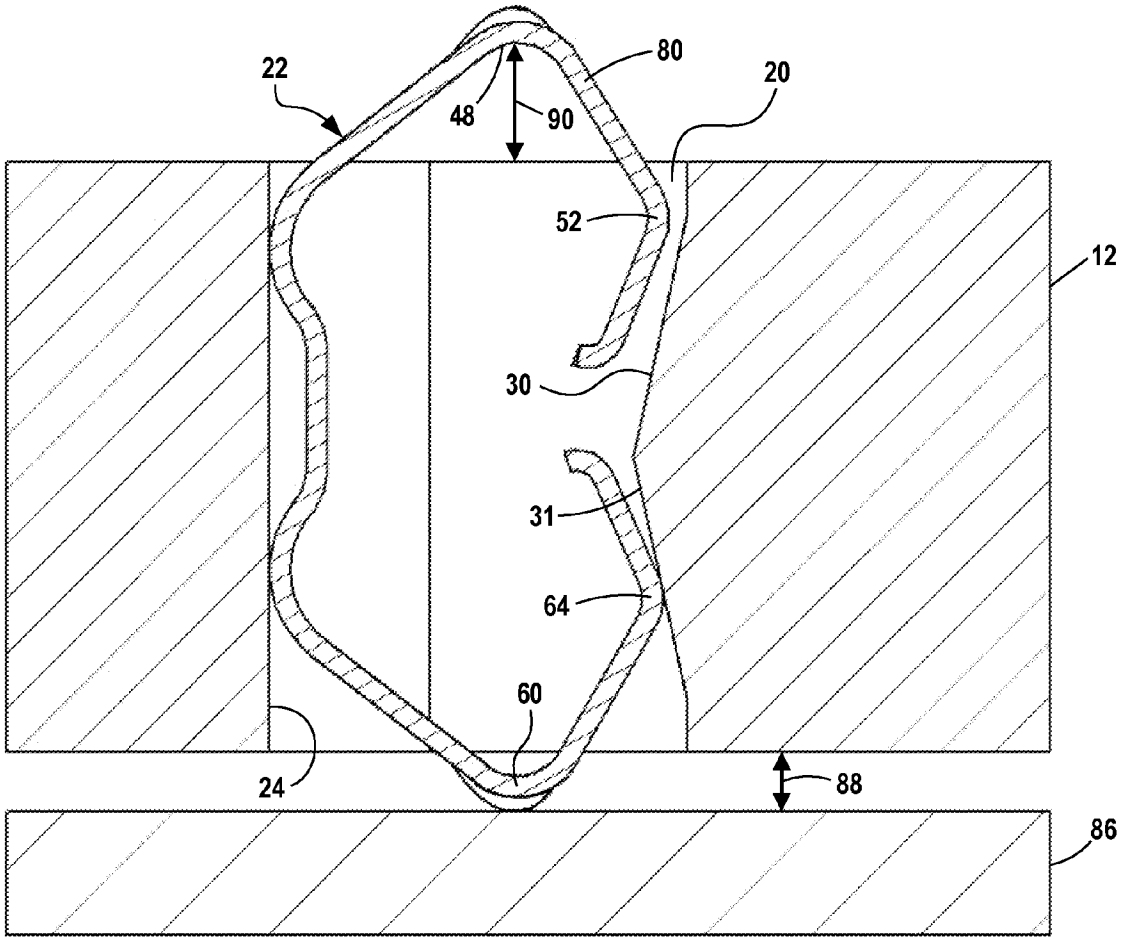
FIG. 4 is a sectional view similar to FIG. 3 showing the assembly positioned on a lower substrate with the contact raised up in a through passage.

Assembly 10 with contacts inserted and in the gravity down position as shown in FIG. 3 is placed on lower substrate 86 as illustrated in FIG. 4. The substrate has a contact pad (not illustrated) located below each contact for engagement with lower contacts 60, as illustrated. When the assembly is placed on substrate 86, the plate 12 is lowered until the contact points 60 engage the pads on the substrate and cam surfaces 31 engage support bends 64, as shown in FIG. 4. The contacts 22 are raised up in passages 20 to an elevated position. Support bend 52 is above cam side 30. The plate 12 is held in position of FIG. 4 by gravity and is supported by engagement between contact support bends 64 and lower cam surfaces 31. Plate 12 is a distance 88 above the substrate 86 as illustrated in FIG. 4. The contact 22 is raised up in passage 20 with contact point 48 a distance 90 above the top of the plate which is greater than the distance 88 contact 60 is below the bottom of the plate.

With the contacts in the position of FIG. 4, an upper substrate 92 is placed on the top of plate 12. The upper substrate has contact pads (not illustrated) which engage the upper contacts 48. The upper substrate 92 is lowered toward the lower substrate 86 to compress the raised contacts 22 into passages 20. The contacts are in the position shown in FIG. 4 when first engaged by upper substrate 92. Supports 42 and 44 slide down along walls 24. Arms 46 are bent down into passages 20 to move bends 52 into engagement with upper cam sides 30 and, with further lowering of substrate 92, down along cam sides 30. At this time, arms 58 are bent upwardly, and bends 64 are correspondingly moved up along lower cam sides 31. The bending of arms 46 and 58 moves contact points 48 and 60 along the contact pads on the upper and lower substrates 92 and 86 to form wiped electrical connections between the pairs of contact points 48 and 60 on contact 22 and the pads.

Figure 5:
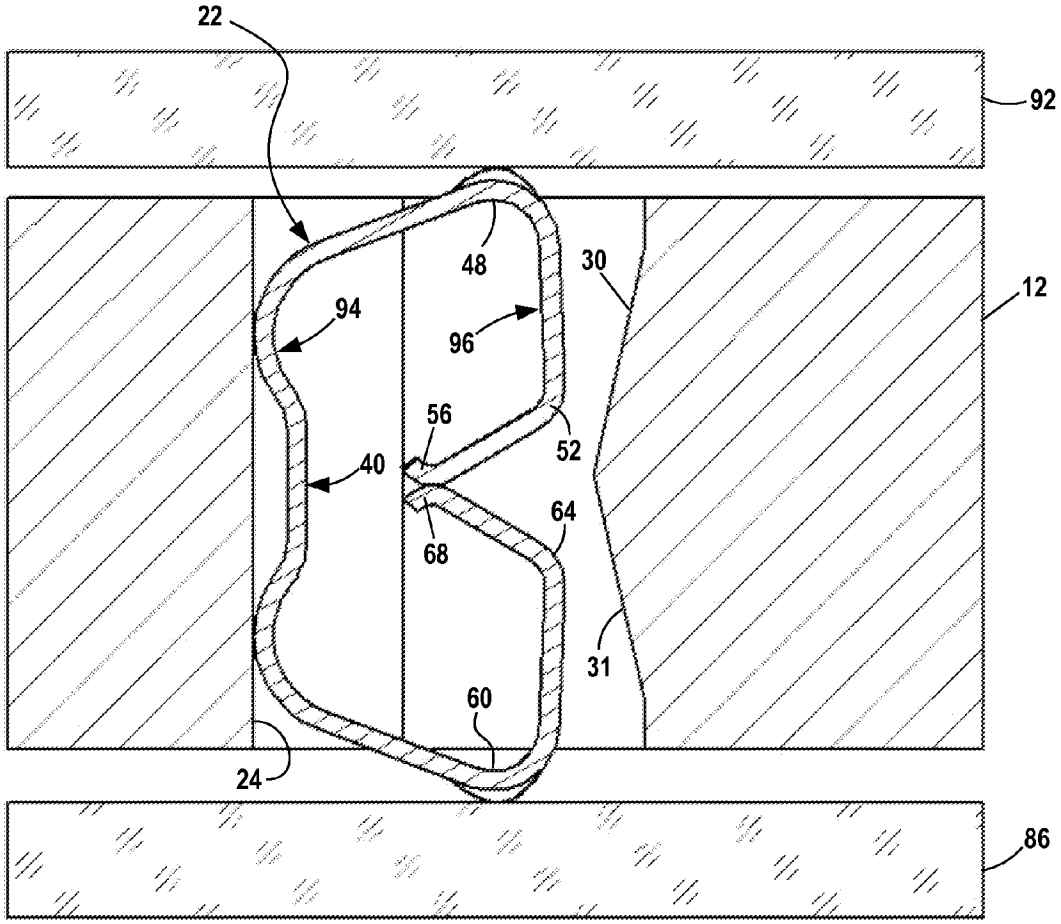
FIG. 5 is a view similar to FIG. 4 showing an upper substrate on the top of the plate supported by contacts with the contact partially compressed.

As contacts 22 are compressed, the support bends 52 and 64 are moved inward along cam sides 30 and 31 to bend the upper and lower portions of contact 52 toward wide end wall 24 until rounded contact ends 56 and 68 engage each other and, with further lowering of the upper substrate 90 towards the lower substrate 86 and collapse of the contact, the contact is bent toward wall 24 and out of engagement with wall 26. See FIG. 5.

Figure 6:
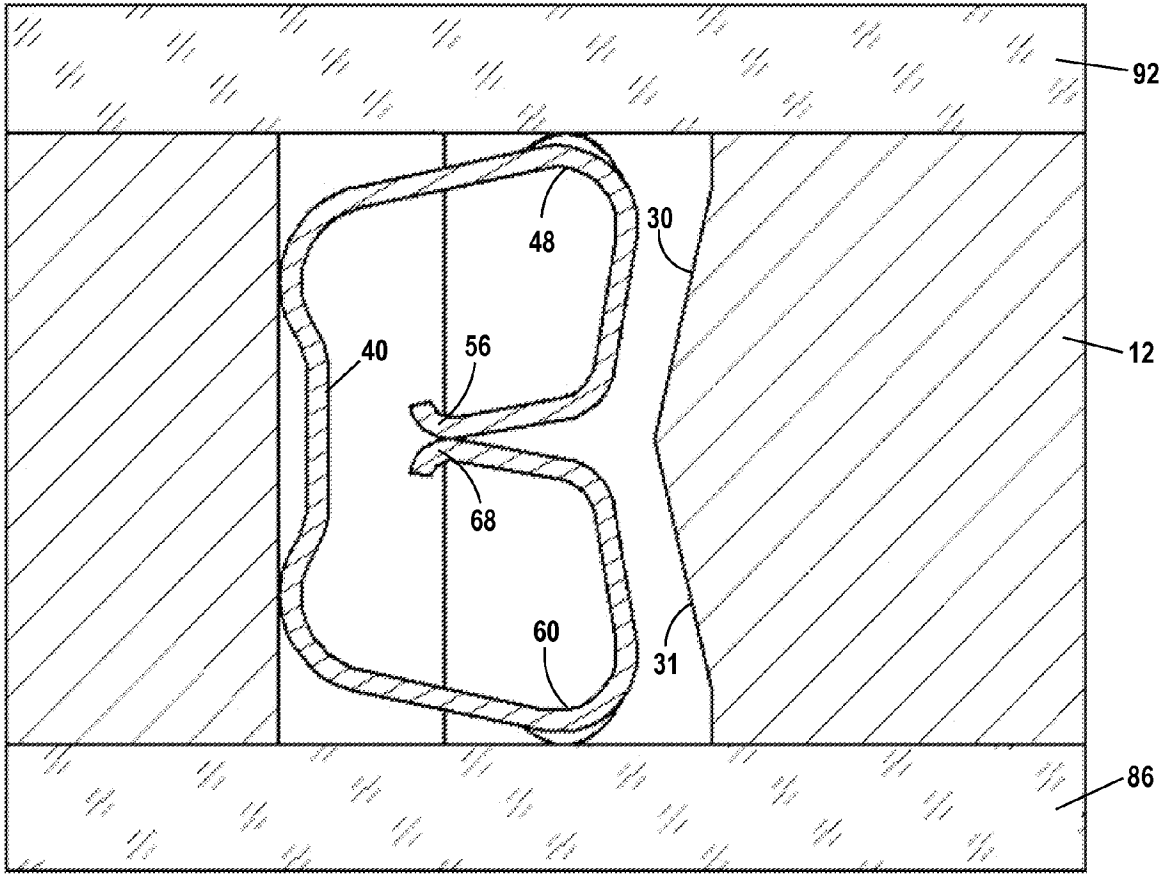
FIG. 6 is a sectional view similar to FIG. 5 showing the upper and lower substrates sandwiched onto the plate and the contact fully compressed to form two circuit paths.
Figure 7:
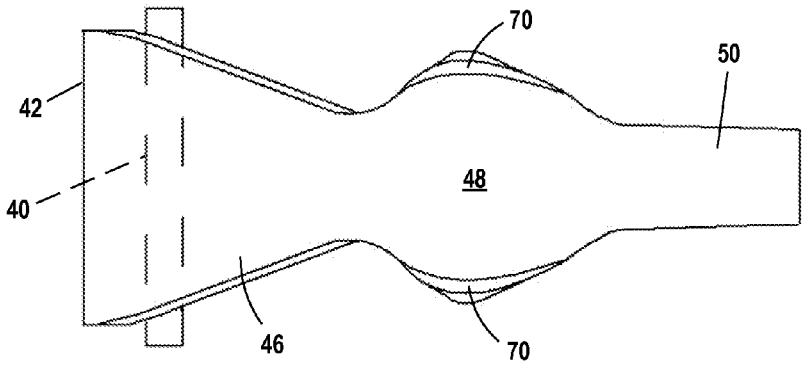
FIGS. 7, 8 and 9 are top and opposed side views of the contact.
Figure 8:
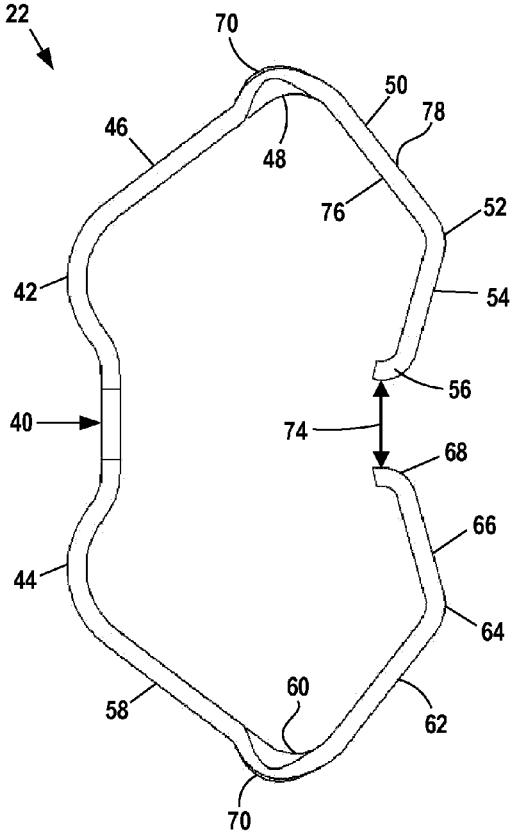
Figure 9:
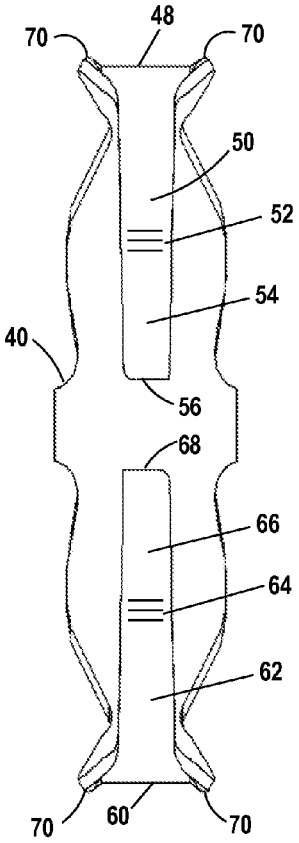

Further downward movement of substrate 90 collapses the substrates against the top and bottom surfaces 14 and 16 of plate 12 as shown in FIG. 6. During this movement, the contact 22 is further compressed and the point of physical engagement between ends 56 and 68 is moved inwardly along the adjacent surfaces of the ends. Compare FIGS. 5 and 6. The electrical connection between the redundant contact ends 56 and 68 establishes a second or redundant electrical circuit path between contact points 48 and 60.

A first continuous metal circuit path between the contact points extends from upper contact point 48 through arm 46, spine 40 and arm 58 to lower contact point 60. A second or redundant continuous metal circuit path extends from contact point 48 through arm 50 and strip 54, ends 56 and 68 and arms 66 and 62 to contact point 60.

During compression of the contacts in passages 20, the bends 52 and 64 rotate out of engagement with cam sides 30 and 31. The contacts are free to move vertically in the passage with the spine supports 42 and 44 sliding along wall 24. This freedom of vertical movement desirably equalizes the contact pressures at the top and bottom of the contact to ensure that a reliable electrical connection is formed between each contact point 48, 60 and the pad on the adjacent substrate.

The redundant circuit paths between the two contact points 48 and 60 reduce electrical resistance between the contacts and reduce high speed inductance between contacts in plate 12.

During collapse of contacts 22 and formation of the second, redundant electrical connections between points 48 and 60, variables inherent in the manufacture of interposer assemblies, their components and the location and movements of the components affect the connections between the contact ends 56 and 68. Mating with contact pads on the opposed substrates is never perfectly symmetrical. Parts have dimensional tolerances which affect mating. The result of these variables is that during collapse of the contacts and formation of the connections between ends 56 and 68, the support bends 52 and 64 engage the cam sides 30 and 31 at different times so that the rounded ends 56 and 68 move along each other to form wiped pressure connections between the ends. The wiped connections at ends 56 and 68 reduce resistance in the second or redundant contact path formed between points 48 and 60 shown in FIG. 6. Depending upon the order in which the bends 52 and 64 engage sides 30 and 31, the wiped contact path may be formed by rounded end 56 sliding inwardly along end 68 or end 68 sliding inwardly along rounded end 56. In the disclosed assembly 10, the wipe distance between ends 56 and 68 may be 0.15 mm.

As illustrated in FIG. 6, compressed contact 22 includes a first circuit path 94 extending across the thickness of plate 12 from contact point 48 to contact point 60. The compressed contact also includes a second circuit path 96 extending across the height of plate 12 between points 48 and 60. The two paths 94 and 96 substantially extend through the full length of the metal contact 22 to eliminate any substantial antenna or stub portion of the contact outside of the electrical loop for the contact. Elimination of the stubs prevents radiation of current passing through the contact and, as a result reduces signal loss at the contact.

What we claim as our invention:

1. An interposer plate assembly for forming two-path electrical connections between contact pads on opposed substrates, the interposer plate assembly comprising: a molded plastic plate having a top surface, a bottom surface, a uniform thickness between the surfaces, and a plurality of like contact passages extending through the thickness of the plate, each like contact passage comprising opposed first and second end walls, the first end wall perpendicular to the top and bottom surfaces of the molded plastic plate and the second end wall forming a protrusion facing the first end wall; and a plurality of metal contacts, each metal contacts positioned in a like contact passage when not compressed, the metal contacts formed from an elongate strip of uniform-thickness metal stock, each strip bent to form a loop with continuous inner and outer circumferential surfaces perpendicular to a transverse plane, contact ends on the elongate strip, a gap separating the contact ends when the contact is not compressed, a rigid spine in the elongate strip across from the contact ends, opposed contact points at the top and the bottom of the contact, and a support bend between each contact point and a contact end, each contact point between the spine and a contact end, the contact points spaced apart a distance greater than the thickness of the molded plastic plate when the contact is not compressed; each contact having a maximum width at locations above and below the protrusion when not compressed greater than the minimum width of the like contact passage at the protrusion so that the contact is confined in the like contact passage but is movable vertically in the like contact passage when not compressed; the metal contacts each having a compressed position in the like contact passage with the contact points engaging pads on substrates above and below the molded plastic plate top and bottom surfaces, the gap is closed, the elongate strip ends engage each other in the like contact passage to form an electrical connection, and the support bends are spaced inwardly from the second end wall; whereby compressed connectors each form redundant circuit paths between the contact points, one circuit path extending through the spine and the other circuit path extending through the support bends, the contact ends and the electrical connection.

2. The interposer plate assembly as in claim 1 including a wiped electrical connection between the contact ends.

3. The interposer plate assembly as in claim 2 wherein each electrical connection has a wiped distance of about 0.15 mm.

4. The interposer plate assembly as in claim 3 wherein in each contact the ends are rounded and the wiped connection extends around each free end.

5. The interposer plate assembly as in claim 1 wherein each metal contact is formed from strip stock having a thickness of about 0.043 mm.

6. The interposer plate assembly as in claim 5 wherein the strip stock is gold coated beryllium copper.

7. The interposer plate assembly as in claim 1 wherein the metal contacts are vertically symmetrical.

8. The interposer plate assembly as in claim 1 wherein the metal contacts each include two generally flat spring arms between each contact point and a rounded end and each support bend is between two elongate strips.

9. The interposer plate assembly as in claim 1 wherein each metal contact end has an outer rounded surface, said electrical connection extending through the outer rounded surfaces at both contact ends.

10. The interposer plate assembly as in claim 1 wherein each the metal contact consists of said elongate strip.

11. The interposer plate assembly as in claim 1 wherein in each like contact passage, the contact spine includes spaced supports engaging the first end wall wherein the contact is vertically movable in the like contact passage.

12. A method of forming redundant electrical connections between contact pads on opposed substrates comprising the steps of:

A. providing a flat dielectric plate having top and bottom surfaces, a uniform thickness and a plurality of contact passages extending through the thicknesses of the plate, each passage having a support wall and an opposed retention wall with a protrusion;

B. providing a plurality of metal contacts, each contact having a resilient circumferential strip body forming a band with ends spaced apart when the contact is not compressed, a rigid spine opposite from the ends, contact points between the ends and spine, and support bends between the contact points and the ends;

C. loosely positioning the metal contacts in the contact passages with the spines on the support walls and one support bend of each contact engaging a protrusion and the contact ends located above and below the protrusions for free vertical movement in the passage;

D. moving upper and lower substrates onto the top and bottom surfaces of the plate to form electrical connections between pads on the substrates and the contact points, and moving the contact ends away from the protrusion and into physical contact with each other in the center of the passage to form an electrical connection between the contact ends; and E. forming redundant circuit paths between the contact points with a first circuit path extending through the spine and a second circuit path extending through the support bends, the contact ends and the electrical connection between the points.

13. The method of claim 12 including the step of:

F. forming a wiped electrical connection between the ends of each contact.

14. The method of claim 12 including the step of:

G. forming each electrical connection by rotating the contact ends together.

15. The method of claim 12 including the step of:

G. during step D., rotating the support bends away from the protrusion.

* * * * *